US007987758B2

(12) United States Patent
Chabansky

(10) Patent No.: US 7,987,758 B2
(45) Date of Patent: Aug. 2, 2011

(54) ROLLED MEDIA CUTTER

(75) Inventor: Bruce Chabansky, Palo Alto, CA (US)

(73) Assignee: Inovent LLC, Palo Alto, CA (US)

( * ) Notice: Subject to any disclaimer, the term of this patent is extended or adjusted under 35 U.S.C. 154(b) by 0 days.

(21) Appl. No.: 12/174,917

(22) Filed: Jul. 17, 2008

(65) Prior Publication Data

US 2008/0271582 A1 Nov. 6, 2008

Related U.S. Application Data

(63) Continuation of application No. PCT/US2007/001696, filed on Jan. 18, 2007.

(60) Provisional application No. 60/761,045, filed on Jan. 20, 2006.

(51) Int. Cl.
*B26D 1/04* (2006.01)

(52) U.S. Cl. ..... 83/614; 83/821; 83/697

(58) Field of Classification Search ..... 83/471, 83/469, 471.2, 561, 562, 477.2, 651, 697, 83/698.41, 676, 523, 485, 455, 574, 614, 83/821; 30/343, 280; 211/45, 59.2
See application file for complete search history.

(56) References Cited

U.S. PATENT DOCUMENTS 312,043 A * 2/1885 Van Horn ..... 30/292
760,800 A * 5/1904 Nice ..... 83/455
794,060 A * 7/1905 Uzel ..... 29/564
808,661 A * 1/1906 Jacobson ..... 83/485
909,227 A * 1/1909 Ridgely ..... 83/485
966,356 A * 8/1910 Pollock ..... 83/485
1,892,544 A * 12/1932 Wanders ..... 242/588.6
2,393,384 A * 1/1946 Kress ..... 83/614
2,559,088 A * 7/1951 Pierce ..... 83/468
3,137,192 A * 6/1964 McNeill ..... 83/455
3,142,217 A * 7/1964 Busse ..... 83/375
3,143,023 A * 8/1964 Addin ..... 83/472
3,173,590 A 3/1965 Bahnsen ..... 225/33
3,310,167 A * 3/1967 Knox ..... 242/593
3,821,915 A * 7/1974 Larrable ..... 83/174
3,930,697 A * 1/1976 Barouh et al. ..... 312/34.22
4,197,774 A * 4/1980 Singh et al. ..... 83/374
4,245,536 A * 1/1981 Urion ..... 83/821
4,291,516 A * 9/1981 Warner et al. ..... 53/219
4,369,929 A * 1/1983 Cayer ..... 242/423.1
4,779,500 A * 10/1988 Bennett et al. ..... 83/208
4,787,284 A * 11/1988 Chen ..... 83/614
4,930,759 A * 6/1990 Potter et al. ..... 269/54.5
(Continued)

OTHER PUBLICATIONS

International Search Report and Written Opinion, PCT/US07/01696, Nov. 2, 2007, 7 pgs.

*Primary Examiner* — Sean Michalski
(74) *Attorney, Agent, or Firm* — Morgan, Lewis & Bockius LLP

(57) ABSTRACT

The rolled media cutter includes an elongated tray and a cutting mechanism. The elongated tray includes first and second substantially parallel channels. The first channel is formed in the tray and is configured to receive the rolled media therein. The cutting mechanism is configured to be slidingly coupled to the second channel. The cutting mechanism includes a cutting surface and a slider coupled to the cutting surface. The slider is configured to be retained within the channel so as to prevent the cutting mechanism from being removed from a portion of the second channel.

16 Claims, 10 Drawing Sheets

U.S. PATENT DOCUMENTS 5,036,740 A * 8/1991 Tsai ..... 83/455
5,044,241 A * 9/1991 Labrecque ..... 83/489
5,069,097 A * 12/1991 Mori ..... 83/56
5,103,710 A * 4/1992 Ross ..... 83/485
5,207,367 A * 5/1993 Dunn et al. ..... 225/49
5,233,793 A * 8/1993 Dandurand ..... 451/461
5,301,854 A * 4/1994 Scobey ..... 225/34
5,305,937 A * 4/1994 Barnett ..... 242/594.6
5,322,001 A * 6/1994 Boda ..... 83/485
5,398,576 A * 3/1995 Chiu ..... 83/614
5,440,961 A * 8/1995 Lucas et al. ..... 83/455
5,480,080 A * 1/1996 Ferguson ..... 225/1
5,561,905 A * 10/1996 Sherman ..... 30/280
5,758,559 A * 6/1998 Capitao et al. ..... 83/614
5,772,052 A * 6/1998 Campbell ..... 211/44
5,881,463 A * 3/1999 Casteel et al. ..... 30/280
D417,693 S * 12/1999 Daley, Jr. ..... D18/34.8
5,996,459 A * 12/1999 Cornell et al. ..... 83/485
6,006,502 A * 12/1999 Smith ..... 53/461
6,079,307 A * 6/2000 Mori ..... 83/564
6,123,197 A * 9/2000 Marquez et al. ..... 206/575
6,202,867 B1 * 3/2001 Di Blasi et al. ..... 211/188
6,223,639 B1 * 5/2001 Chen ..... 83/614
6,311,627 B1 * 11/2001 Draper et al. ..... 108/50.11
7,111,727 B2 * 9/2006 Small et al. ..... 206/225
7,134,583 B2 * 11/2006 May et al. ..... 225/97
7,249,700 B1 * 7/2007 Watson et al. ..... 225/34
7,299,731 B2 * 11/2007 Schulz ..... 83/614
7,347,132 B2 * 3/2008 Schultz et al. ..... 83/485
7,415,915 B2 * 8/2008 Parrish et al. ..... 83/617
7,424,843 B2 * 9/2008 Guillory ..... 83/614
2003/0140760 A1 * 7/2003 Bory ..... 83/614
2003/0230665 A1 * 12/2003 Small ..... 242/559
2004/0040429 A1 * 3/2004 Nichols et al. ..... 83/455
2004/0149108 A1 * 8/2004 McLean et al. ..... 83/614
2004/0206222 A1 * 10/2004 Chuang ..... 83/614
2004/0216574 A1 * 11/2004 Chabansky ..... 83/574
2004/0221703 A1 * 11/2004 Loibl ..... 83/485
2004/0237746 A1 * 12/2004 Schultz et al. ..... 83/614
2005/0000340 A1 * 1/2005 Petersen ..... 83/485
2005/0005755 A1 * 1/2005 Turvey et al. ..... 83/614
2005/0034584 A1 * 2/2005 Antal et al. ..... 83/614
2005/0035133 A1 * 2/2005 Gerulski et al. ..... 221/31
2005/0166738 A1 * 8/2005 Hsu ..... 83/614
2006/0053994 A1 * 3/2006 Carrillo et al. ..... 83/485
2006/0117925 A9 * 6/2006 Volfson et al. ..... 83/485
2006/0156885 A1 * 7/2006 Wu ..... 83/485
2006/0219078 A1 * 10/2006 Parrish et al. ..... 83/614
2006/0236831 A1 * 10/2006 Walsh et al. ..... 83/13
2007/0044617 A1 * 3/2007 Pavlik ..... 83/614
2007/0125214 A1 * 6/2007 Dong et al. ..... 83/485
2008/0034936 A1 * 2/2008 Loibl ..... 83/455
2009/0145277 A1 * 6/2009 Rodriguez ..... 83/455
2009/0188366 A1 * 7/2009 Habra et al. ..... 83/614
2009/0211420 A1 * 8/2009 Loibl ..... 83/485

* cited by examiner

ROLLED MEDIA CUTTER

RELATED APPLICATIONS

This application is a continuation application of PCT application PCT/US2007/001696 filed Jan. 18, 2007 which claims the benefit of U.S. patent application Ser. No. 60/761,045, filed Jan. 20, 2006, all of which are incorporated by reference herein in their entirety.

TECHNICAL FIELD

The disclosed embodiments relate generally to devices for dispensing rolled media, and more particularly, to a system and method for holding and cutting rolled sheets of material.

BACKGROUND

Rolled media, such as rolled sheets of material, including paper, cellophane or foil, can be large and heavy. Such media is often difficult to pick-up and carry about. When cutting or tearing rolled media it is often important that the cut is made accurately (with the cut or tear being parallel to the longitudinal axis of the roll), completely (with the cut or tear straight all the way across the media) and cleanly (resulting in a smooth straight edge on the divided media). However, it can be difficult for a single person to unroll the media and then cut a straight and parallel line across the length of the roll. In fact, cutting rolled media with handheld devices, such as scissors, often results in an uneven edge that is neither parallel to the longitudinal axis of the roll or completely across the rolled media's length.

Furthermore, the most common devices for dispensing rolled media include a serrated edge for tearing the unrolled media. However, these devices tend to create a torn, rough and uneven edge and are often unable to cut non-paper media, like film material, foil or cellophane. Current devices are also aesthetically unpleasing, bulky, expensive to manufacture, and do not allow for customization to meet individual user's requirements.

Moreover, cutting or tearing rolled media while the roll is resting on a flat surface, such as a counter top, often results in the roll sliding away from the user as the leading edge is pulled away from the roll. Conversely, the roll can also move forward toward the user while the cut is being made, interfering with the cutting process.

Accordingly, it is highly desirable to provide a system and method for holding and cutting rolled sheets of material that addresses the above drawbacks of current designs.

SUMMARY

A device for cutting rolled sheets of material includes an elongated tray having opposing first and second ends and a cutting mechanism. The tray includes a first channel formed in the tray, wherein the first channel is configured to receive a roll of material therein, and a second channel disposed substantially parallel to the first channel. The cutting mechanism is configured to be slidingly coupled to the second channel and includes a cutting surface, and a slider coupled to the cutting surface and configured to be retained within the channel so as to prevent the cutting mechanism from being removed from the second channel along at least a portion of the second channel.

A rolled media cutter includes an elongated tray having opposing first and second ends, a cutting mechanism, and two end-caps. The tray includes a first channel formed in the tray, wherein the first channel is configured to receive a roll of media therein, and a second channel disposed parallel to the first channel. The cutting mechanism is slidingly coupled to the second channel and includes a blade and a slider coupled to the blade and configured to prevent the cutting mechanism from detaching from the second channel along at least a portion of the second channel. The two end-caps are coupled to a respective one of the opposing first and second ends and configured to prevent the cutting mechanism from being separated from the second channel. The end-caps also optionally include at least one vertical support configured to support a second elongated tray.

A device for cutting rolled sheets of material includes an elongated tray having opposing first and second ends and cutting mechanism configured to be slidingly coupled to the second channel. The tray includes a first channel formed in the tray, wherein the first channel is configured to receive a roll of material therein, and a second channel disposed substantially parallel to the first channel.

Accordingly, the embodiments provide for a convenient method for supporting and unrolling rolled media in a substantially stable position, and allowing for straight cuts to be made thereon.

BRIEF DESCRIPTION OF THE DRAWINGS

Like reference numerals refer to corresponding parts throughout the drawings.

DESCRIPTION OF EMBODIMENTS

A rolled media cutter constructed according to embodiments of the present invention is shown generally in FIGS. 1-6, while a system created by combining multiple trays and optional components is shown in FIGS. 7-10.

Figure 1:
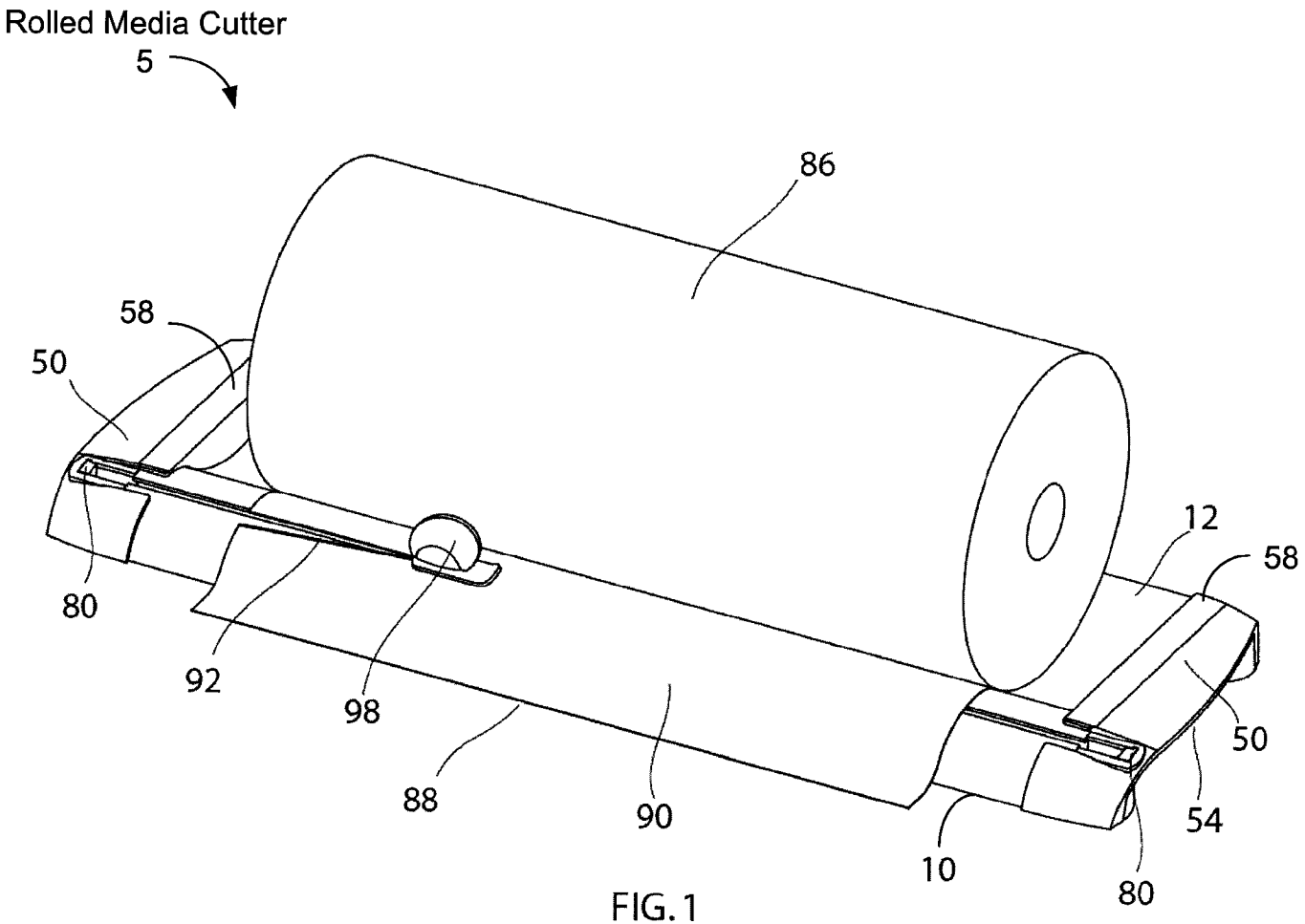
FIG. 1 is a perspective view of the rolled media cutter, according to an embodiment of the present invention.
Figure 2A:
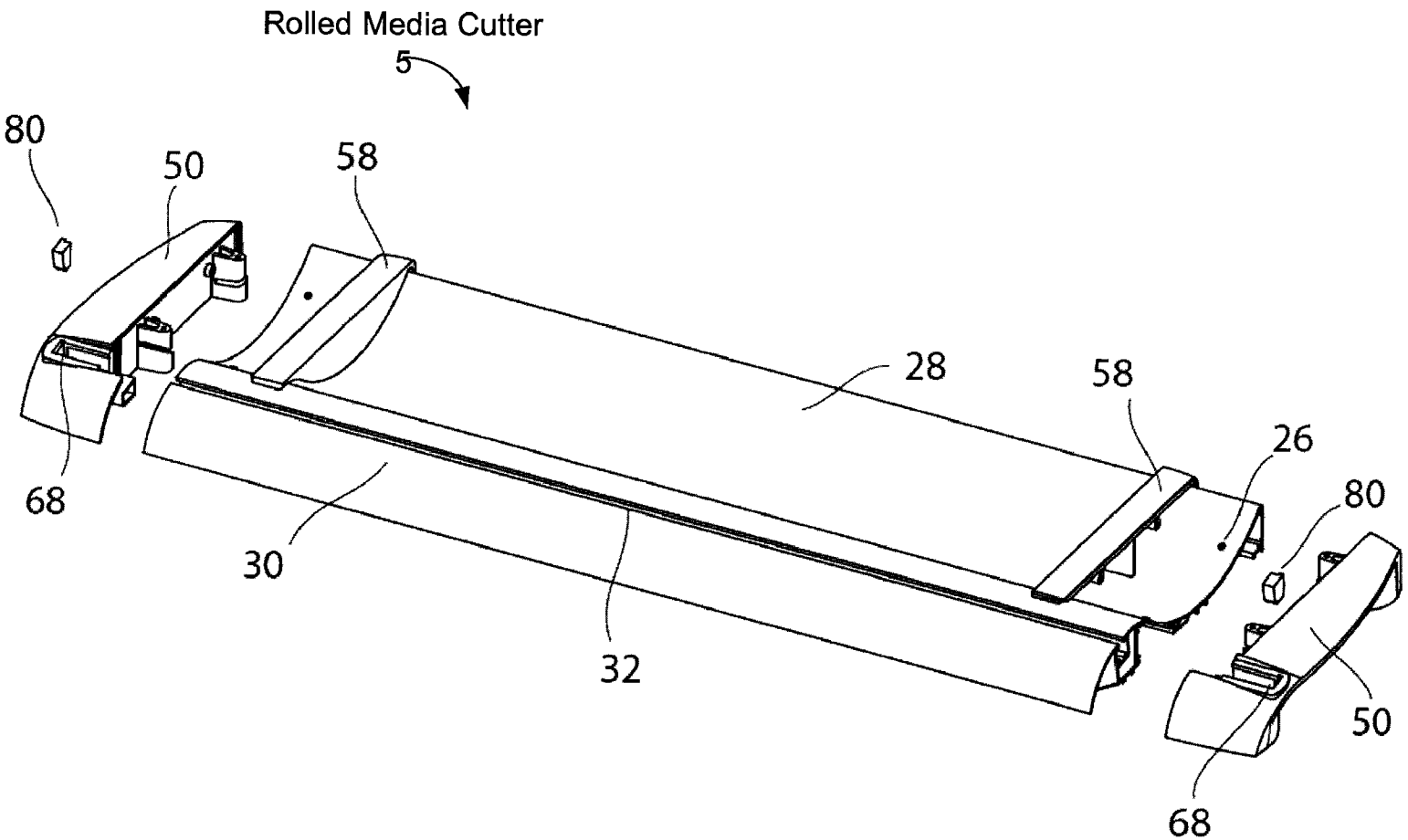
FIG. 2A is a exploded perspective view of the tray shown in FIG. 1, according to an embodiment of the present invention.
Figure 2B:
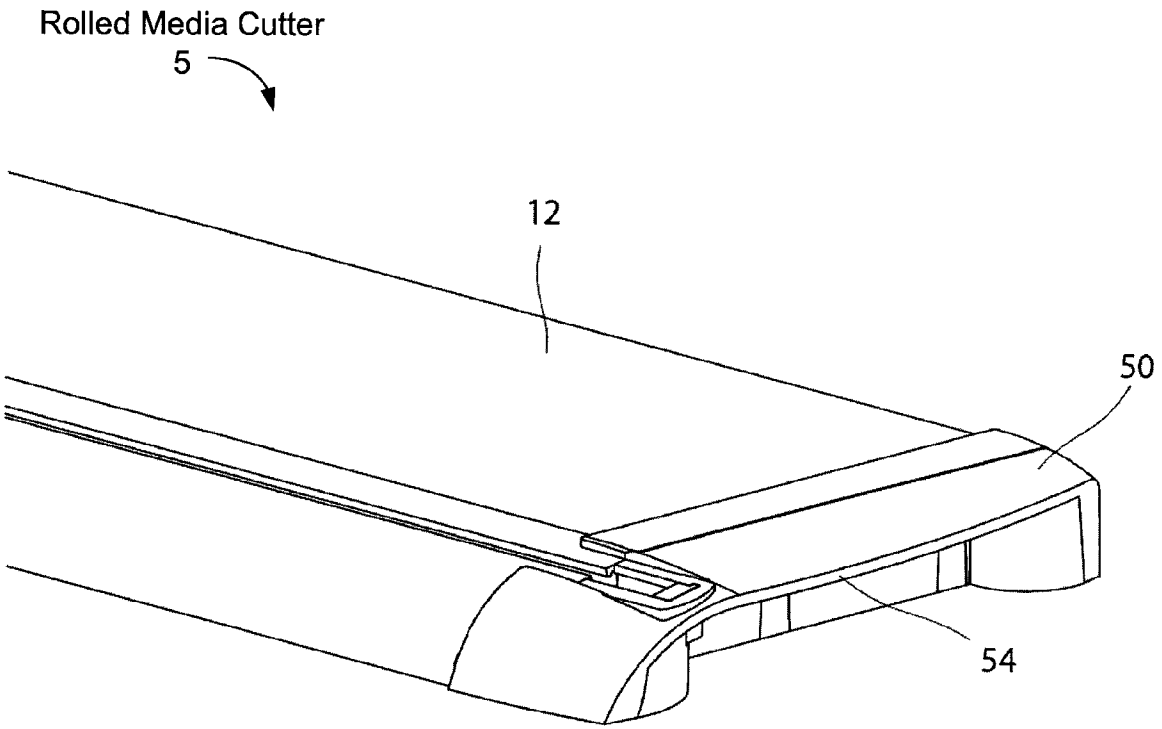
FIG. 2B is an enlarged perspective view of one end of the rolled media cutter shown in FIG. 1, according to another embodiment of the present invention.

FIGS. 1, 2A, and 2B are perspective views of the rolled media cutter 5 according to an embodiment of the present invention. The rolled media cutter 5 facilitates the dispensing of rolled media 86 including any rolled sheets of material, such as paper, cellophane, foil, or the like. In particular, the rolled media cutter 5 both holds the rolled media 86 and provides a mechanism for accurately cutting sheets of unrolled media from the rolled media 86.

The rolled media cutter includes a tray 10 and a cutting mechanism 98. In some embodiments, the tray 10 includes an elongated base 12 and two end-caps 50 positioned at opposing ends of base 12. The tray 10 includes two parallel and adjacent sections, namely, a cutting section 30 and a holding section 28. In some embodiments, the cutting section 30 has a flat, rounded or convex surface for guiding the unrolled media. Also in some embodiments, the holding section 28 has a channel therein for receiving the rolled media 86. In some embodiments, this channel has a curvature configured and dimensioned with a radius somewhat larger than the rolled media 86. The concave surface of the holding section 28 is formed so that when the rolled media is received within the holding section 28, the longitudinal axis of the rolled media 86 is aligned substantially parallel with the longitudinal axis of the tray 10. In other embodiments the holding section includes an axle supported by one or more vertical supports. The axle is configured to extend at least partially through the hollow core of the rolled media to hold the media in the holding section 28.

As explained in further detail below, the cutting section 30 defines a channel 32 disposed substantially parallel to the longitudinal axis of the tray 10, where the channel is used to guide a cutting mechanism 98 across at least a portion of the length of the tray 10.

The cutting section 30 and the holding section 28 may form an integral part or two separate components joined together. These sections 28, 30 may be made from any suitable materials using any suitable process, such as extruded aluminum or injection molded plastic. In embodiments where the sections 28, 30 are made from an aluminum extrusion process, the cutting section 30 and the holding section 28 are extruded separately due to limitations in the manufacturing process that cannot produce both thin as well as wide cross-sections as a single component. In some embodiments, the surface of the holding section 28 is made of a smooth anodized aluminum to allow the easy unrolling of the media 86 when its leading edge 88 is pulled towards the user, while the weight of the rolled media 86 provides resistance against it being pulled too quickly. Alternatively, the surface of the tray 10 may be coated with any suitable material and have any desired surface roughness to facilitate the easy dispensing of the media. For example, the surface may be coated with a TEFLON material to increase or reduce the friction of the media against the tray 10.

Figure 5:
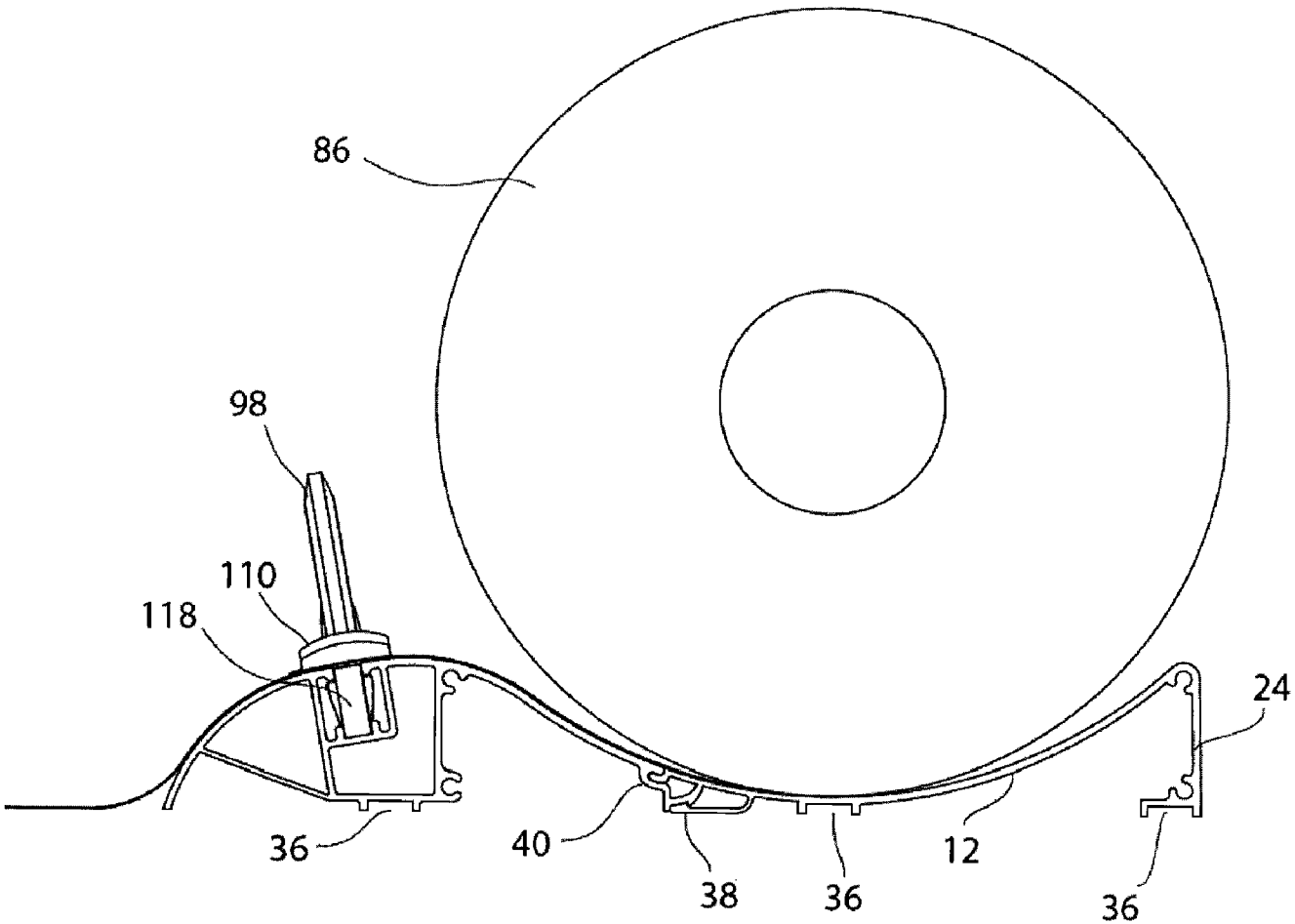
FIG. 5 is a side view of the rolled media cutter of FIG. 1 with an end-cap removed, according to an embodiment of the present invention.

The separate sections 28, 30 are then connected together by means of a tongue and groove mechanism 40 and a snap mechanism 38, as shown in FIG. 5. These mechanisms interlock the two sections during assembly so as to be make separation of the sections difficult, while creating a tight seam between the sections so as not to impede the rolling of the media 86.

The end-caps 50 are attached to opposing ends of the base 12 by any suitable means. For example, as shown in FIG. 2A, projections extending from the end-caps 50 are slid into channels formed in the base 12; the end-caps are secured to the base 12 by fastening screws into the holes 26 formed in the base 12; and snapping the end walls, which conform to the concave shape of the base 12, into the end-caps 50. Alternatively, the end-caps 50 may be formed integrally with the base 12.

In some embodiments, the end-caps 50 include a slot 68, which is configured to be contiguous with the channel 32 formed in the base 12. The slot 68 is dimensioned to receive the cutting mechanism 98 therein when the cutting mechanism 98 is not in use. The opening of the slots 68 in the end-caps 50 are wide enough to allow the cutting mechanism 98 to be removed from the slot when it is lifted away from the slot (vertically in FIGS. 1 and 2). In some embodiments, inadvertent removal of the cutting mechanism 98 may be restricted by means of a plug 80 (FIG. 2) that is inserted into the end of the slot 68 to prevent the entire length on the cutting mechanism 98 from fitting within the slot 68. In some embodiments, the plug 80 may be removed by the user to facilitate the separation of the cutting mechanism 98 from the remainder of the rolled media cutter 5. The end-caps 50 may also be formed with handles 54 (FIGS. 1 and 2B) that can be used for lifting the media roll cutter 5. In addition, the end-caps 50 may also function to protect the user from the sharp edges of the base 12 and to be aesthetically pleasing.

Moreover, the tray 10 can be manufactured in a variety of widths and lengths to accommodate differing widths and lengths of rolled media 86. For example, the tray 10 may have a holding section 28 with a concave surface designed to receive rolls of up to 24 cm in diameter.

Also in some embodiments, the profile of the tray 10 includes a back wall 24 (FIG. 5) that prevents the rolled media cutter 10 from tilting backwards. Rubber feet 36 (FIG. 5) may be disposed underneath the tray 10 to prevent the tray from moving during use when located on a smooth horizontal surface.

Figure 3:
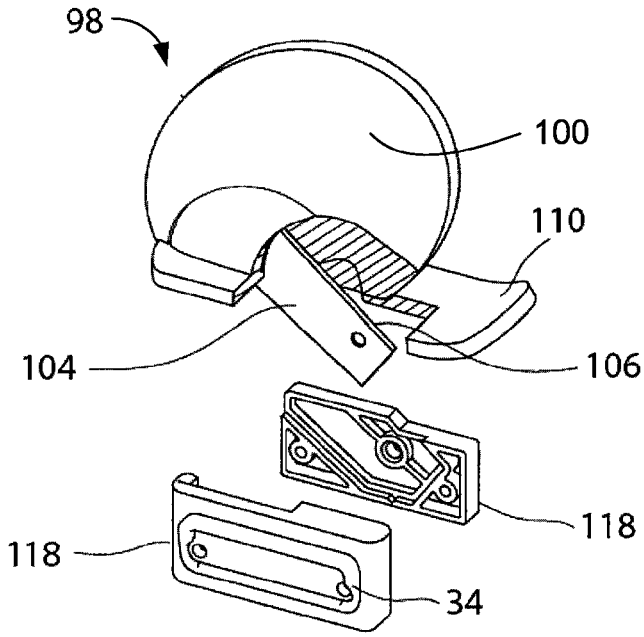
FIG. 3 is an exploded perspective view of the cutting mechanism shown in FIG. 1, according to an embodiment of the present invention.

FIG. 3 is an exploded perspective view of the cutting mechanism 98 shown in FIG. 1. In some embodiments, the cutting mechanism 98 includes a handle 100 that is configured to be held by the user to slide the cutting mechanism along the channel 32 (FIG. 2A). The cutting mechanism 98 is used to cut or slice the surface of the unrolled media 88 (FIG. 1). This cutting is performed a blade 104 or other suitable device, such as a thin wire, laser beam, or the like. The cutting mechanism 98 also includes a slider 118 and ski 110. In some embodiments, the blade 104 is permanently mounted inside the handle 100, while in other embodiments the blade may be removable and replaceable.

The ski 110 has a smooth bottom surface to glide on top of the unrolled media 88 (FIG. 1), while the leading edge of the ski 110 slopes upward to ensure that the unrolled media 88 (FIG. 1) is captured and forced between the ski 110 and the upper surface of the cutting section 30 when the cutting mechanism 98 is slid along the channel 32. The slider 118 is attached beneath the blade 104 and is configured and dimensioned to be received and slide within the channel 32 (FIG. 2A), yet still prevent the cutting mechanism 98 from being separated from the cutting section 32 (FIG. 2A) along its length. In some embodiments, the slider 118 is an assembly made of two parts, which may be molded from a plastic material with a low friction coefficient, such as DELRIN, NYLON, or any other suitable material. In these embodiments, the components are designed to be assembled together to enclose the bottom of the blade 104 to prevent exposure to the blade if the cutting mechanism 98 is separated from the remainder of the rolled media cutter 5. In this embodiment, only a very thin gap between the bottom of the ski 110 and the top of the slider 118 exists to present the blade 104 to the unrolled media. This gap may be restricted to the thickness of media intended to be cut by the rolled media cutter, e.g., one millimeter or less.

Figure 6:
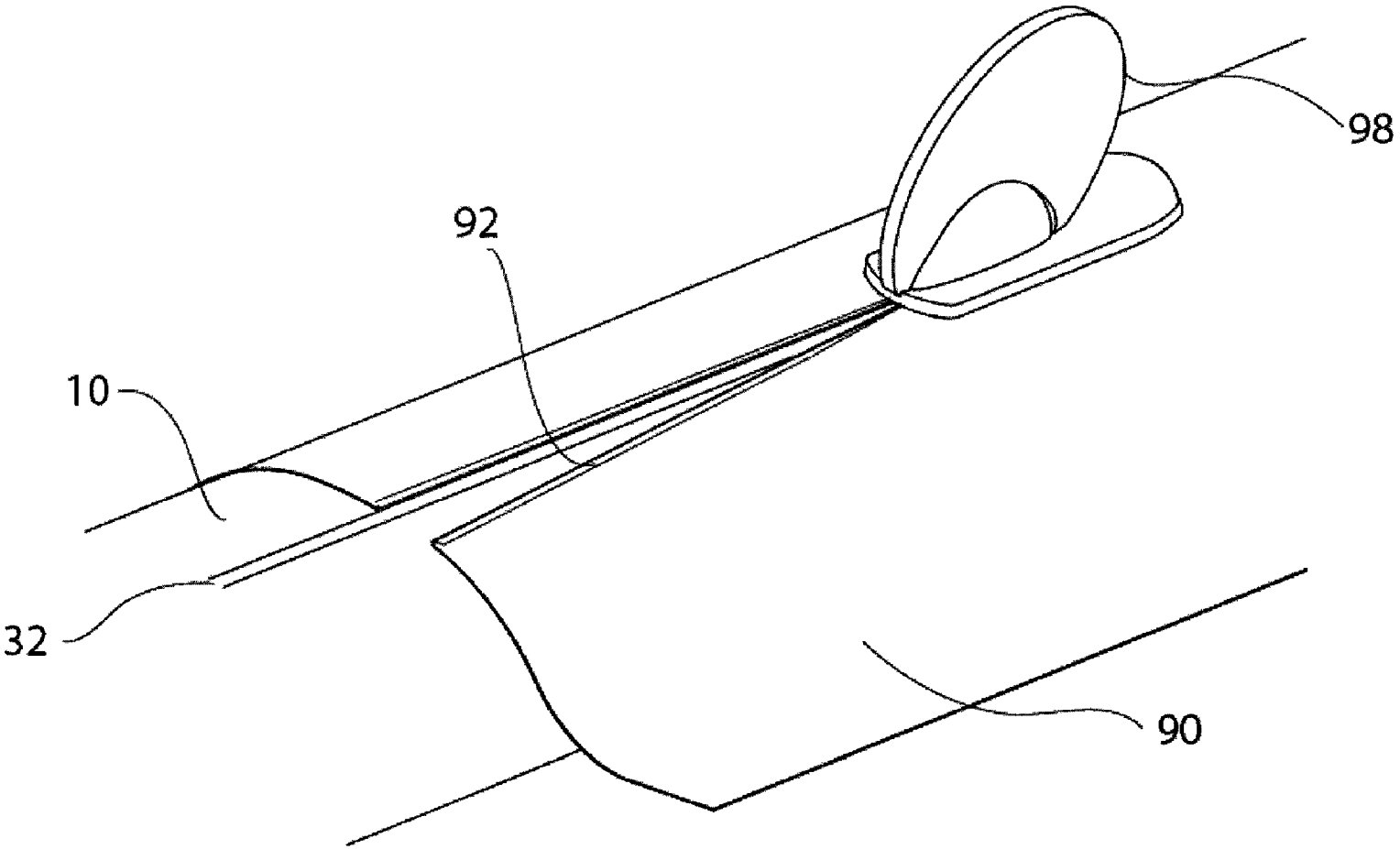
FIG. 6 is a perspective view of a portion of the rolled media cutter of FIG. 1 in a cutting position, according to another embodiment of the present invention.

In some embodiments, the blade 104 is angled at an obtuse angle to the upper surface of the media 86 (rather than an acute angle which is the more common angle of a cutting device). This angle impedes upward curling of the newly-cut edge 92 of the unrolled media 90 as it is being cut, as shown in FIG. 6. Typically, the printed side of the media 86 is on the outside of the roll, so when the media 86 is unrolled the printed section is facing downward, as in FIGS. 1 and 6. Therefore, once the unrolled media 90 is cut using the blade 104, the slight curl of the cut edge is angled upwards, towards the unprinted side of the media 86, rather than towards the printed side where it would be visible upon final use, e.g., when gift wrapping a box.

In some embodiments, the blade 104 has more than one cutting surface such that cutting may be performed when the cutting mechanism 98 is slid along the channel 32 in either direction. In these embodiments, the cutting mechanism 98 may include a ski 110 where both ends of the ski 110 slope upwards in opposite directions, allowing for a leading edge to operate in both directions to ensure that the unrolled media 88 is captured and forced between the ski 110 and the upper surface of the cutting section 30 when the cutting mechanism 98 is slid along the channel 32 no matter which direction the cutting mechanism 98 is being slid along the channel 32. In other embodiments, the cutting mechanism 98 includes two separate skis, each with a leading edge that slopes upwards. According to these embodiments, the skis are configured such the first end of the ski (the non-sloping end) are configured adjacent to each other and the second ends (also known as the leading edge, which is the end that is sloped upwards) face outwardly from each other, thus allowing for the leading edge to operate in both directions to ensure that the unrolled media 88 is captured and forced between the ski 110 and the upper surface of the cutting section 30 when the cutting mechanism 98 is slid along the channel 32 no matter which direction the cutting mechanism 98 is being slid along the channel 32.

Figure 4:
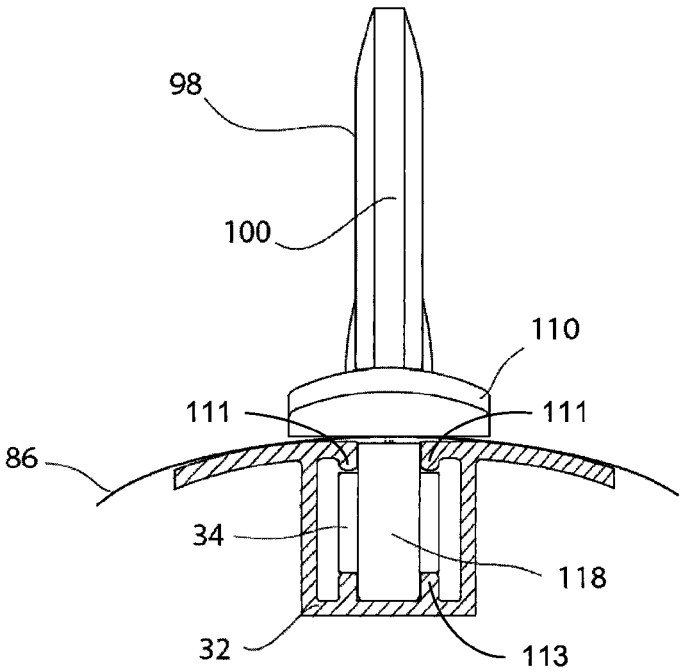
FIG. 4 is a cross-sectional view of the cutting mechanism slidingly coupled to the tray of FIG. 1, according to an embodiment of the present invention.

FIG. 4 is a cross-sectional view of the front of the cutting mechanism 98 slidingly coupled to the tray of FIG. 1, according to some embodiments of the invention. As shown in FIGS. 1 and 2, the channel 32 runs the length of the cutting section 30. In some embodiments, the channel 32 restricts the cutting mechanism 98 to slide only along the fixed path of the channel 32 parallel to the longitudinal axis of the rolled media 86.

In some embodiments, the cutting mechanism 98 may be slid along the path of the channel 32 manually. In some other embodiments, the cutting mechanism 98 may be slid along the path of the channel 32 automatically, for example, by using a mechanical or electro-mechanical device to cause the sliding.

In some embodiments, the slider 118 includes shoulders 34 that extend away from the slider 118 in a direction substantially perpendicular to the length of the channel 32 (see also FIG. 2A). The channel 32 includes an inner channel 113 configured and dimensioned to receive the side of the slider 118 furthest from the handle 100. In some embodiments, the channel 32 also includes opposing yet separated lips or flanges 111 forming an opening or longitudinal slit along the length of the cutting section 30. The width between the flanges 111 (width of the opening or slit) is smaller than the width of the shoulders 34 and only slightly larger than the width of the slider 118. This configuration allows the slider 118 to be guided along the length of the channel 32 by the flanges 111 and inner channel 113 defining its locus or path of motion. However, the flanges 111 located above the shoulders 34 prevent the slider 118 from being separated from the channel 32 in a direction perpendicular to the channel 32, i.e., vertically in FIG. 4. This prevents the cutting mechanism 98 from being separated from the channel 32, except at the ends of the channel. Of course, in other embodiments, portions of the channel 32 may have wider openings so that the cutting mechanisms 98 may be removed from the channel 32 at those wider openings, or the slider 118 may be restrained within the channel 32 by other means such as an inner channel with opposing flanges that act to trap notched shoulders on the slider.

Figure 7:
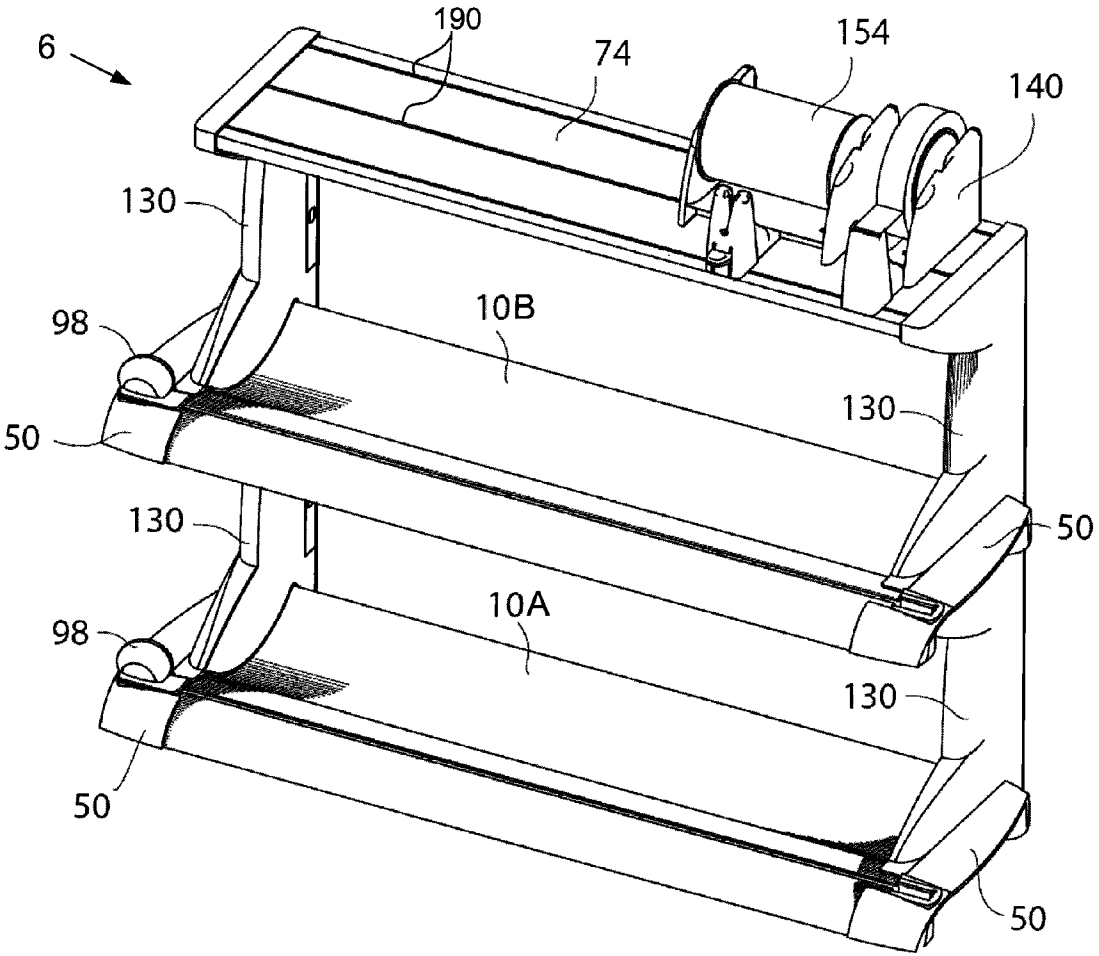
FIG. 7 is a perspective view of a rolled media cutter system, according to yet another embodiment of the present invention.
Figure 8:
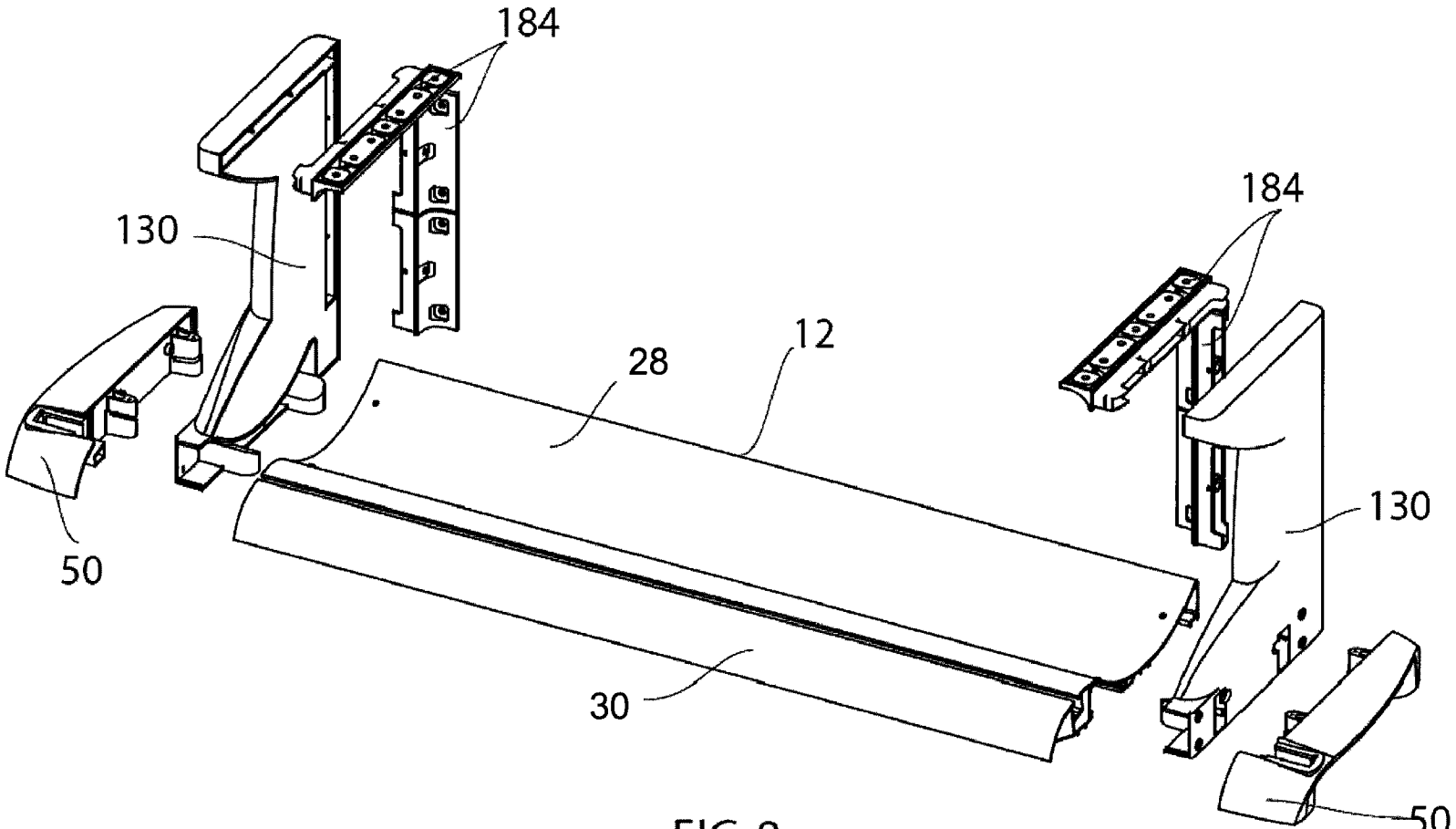
FIG. 8 is an exploded perspective view of a portion of the rolled media cutter system shown in FIG. 7, according to an embodiment of the present invention.

FIG. 7 is a perspective view of a rolled media cutter system 6, according to some embodiments of the present invention, while FIG. 8 is an exploded perspective view of a portion of the rolled media cutter system shown in FIG. 7. In these embodiments, the rolled media cutter system includes multiple stacked trays 10 coupled to one another by supports 130.

The construction of the illustrated system 6 starts with a single tray 10A. The tray 10A is identical to the tray 10 described above in relation to FIGS. 1-6. As shown in FIG. 8, the end-caps 50 of the tray 10A are removed from the tray 10A to allow for the insertion of a set of supports 130 (one on each opposing end of the tray 10A). The end-caps 50 are then reattached to the outside of the supports 130. An additional tray 10B, which is also identical to the tray 10 described above in relation to FIGS. 1-6, is then attached to a side of the supports 130 opposite the first tray (upper side as shown in FIG. 8). In this way, as many trays as is desired may be coupled to one another in a stacked configuration.

In some embodiments, a pair of brackets 184 (FIG. 8) may be coupled to the supports 130, i.e., one bracket per support 130, as shown in FIG. 8. These brackets allow the system 6 to be mounted to a wall or under a counter, such as by securing the bracket 184 to the wall or counter using screws passed through the holes in the bracket 184 shown in FIG. 8.

Like the end-caps 50, the supports 130 may be made from any suitable material using any suitable process, such as an injection molded plastic. Also, the supports 130 may have varying heights to account for different diameters of the rolled media 86 (FIG. 1).

In some embodiments, the system 6 may also couple to a utility shelf 74, as shown in FIG. 7. The shelf may be used to couple to additional accessories, to provide general storage, or to provide display space. For example, a ribbon dispenser 154, a tape dispenser 140 and/or other accessories used in packaging and wrapping may be coupled to the shelf 74. In some embodiments, these accessories may be affixed to grooves formed along the length of the shelf 74.

Figure 9:
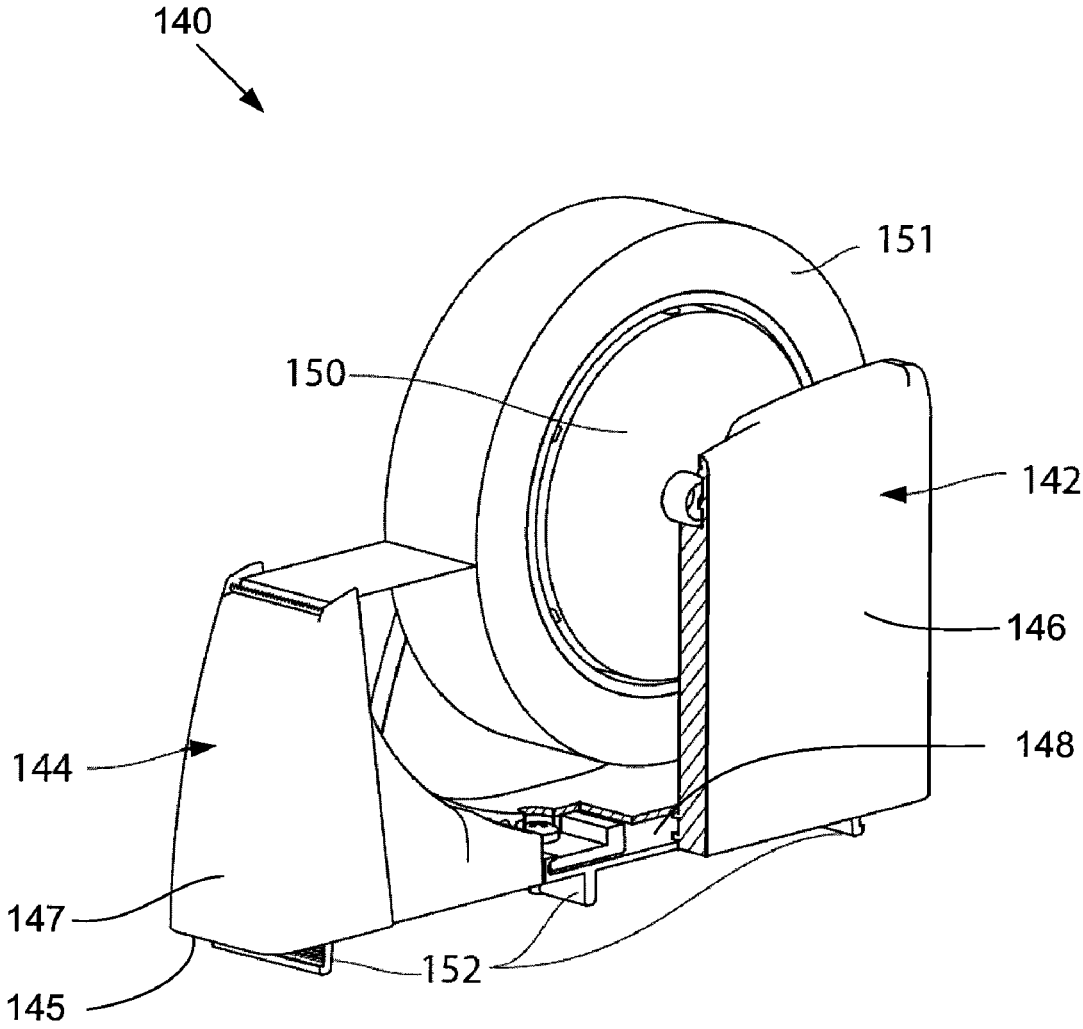
FIG. 9 is a perspective view of the tape dispenser shown in FIG. 7, according to an embodiment of the present invention.
Figure 10:
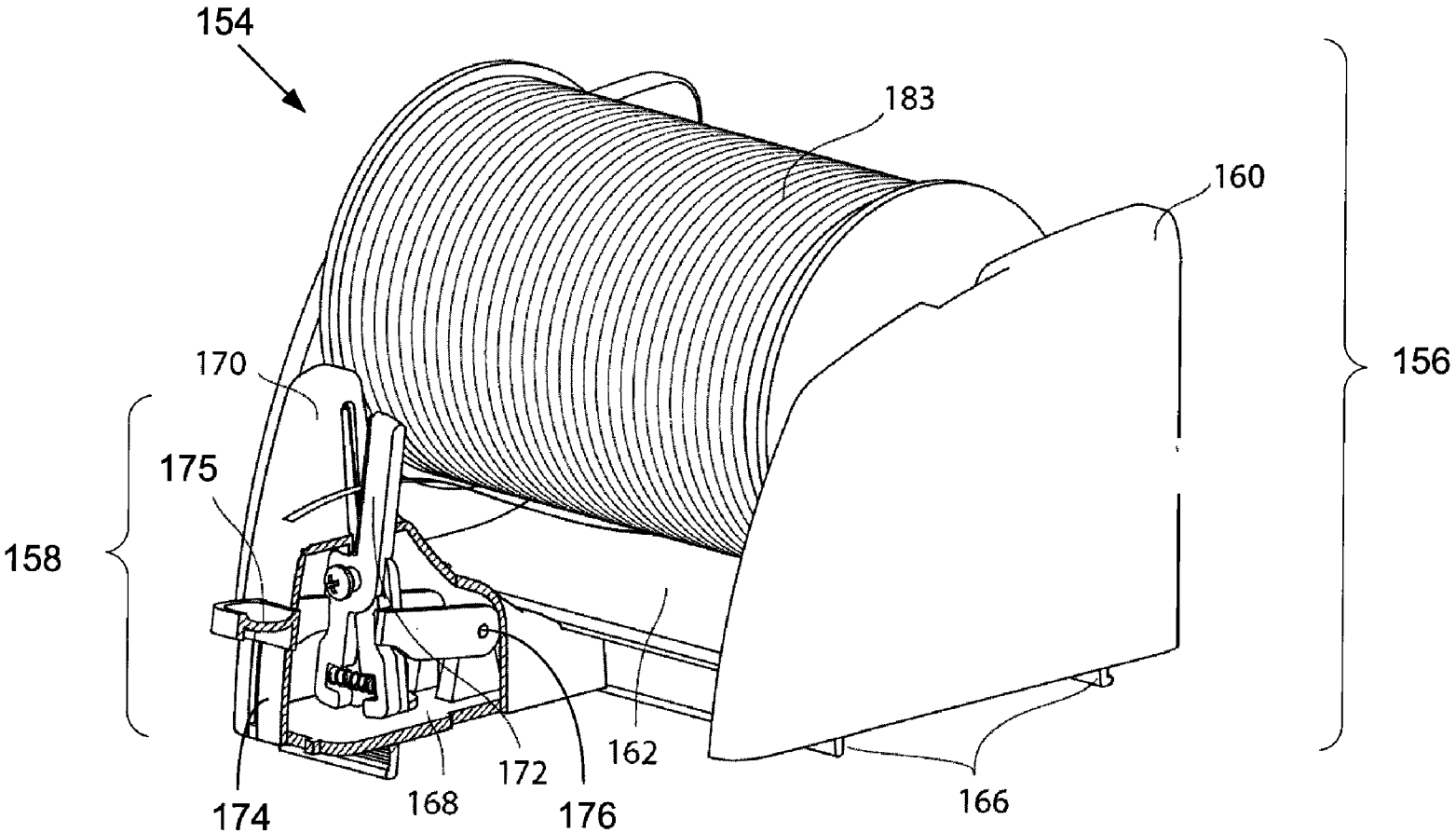
FIG. 10 is a perspective view of the ribbon dispenser shown in FIG. 7, according to an embodiment of the present invention.

FIGS. 9 and 10 show embodiments of the tape dispenser 140 and ribbon dispenser 154 which may be optionally added to the shelf 74. In some embodiments, the tape dispenser 140 (FIG. 9) is made from two separate components, namely, a tape holder 142 and a tape trimmer 144. The tape holder 142 includes two side panels 146, a base 148 and several interchangeable tape spools 150 sized to fit various diameters of adhesive tape 151. In some embodiments, the base 148 attaches to the shelf 74 by means of legs 152 which are configured and dimensioned to be received within grooves 190 formed in the shelf 74. The base 148 may then be affixed to the shelf 74 by means of screws or the like.

The components of the tape holder 142, such as the base 148, may be made from any suitable material using any suitable process, such as an extruded aluminum. The tape holder 142 may also be made in various widths to accommodate different widths of adhesive tape 151. To dispense tape, the leading end of the unrolled adhesive tape 151 is pulled towards the tape trimmer 144, which is made of a trimmer base 145 and a trimmer cover 147. The trimmer base 145 may attach to the shelf 74 by means of legs 152 which are configured and dimensioned to be received in the grooves 190 in the shelf 74. In some embodiments, a blade with serrated edges is fitted on top of the trimmer cover 147 for trimming the unrolled adhesive tape by forcing the tape against the blade (downwards in FIG. 9).

FIG. 10 is a perspective view of the ribbon dispenser 154 shown in FIG. 7. In some embodiments, the ribbon dispenser 154 (FIG. 10) is made from two separate components, namely, a ribbon holder 156 and a ribbon trimmer 158. The ribbon holder 154 includes two side panels 160, a base 162 and an axle sized to fit through the core of a ribbon bobbin 183. In some embodiments, the base 162 attaches to the shelf 74 by means of legs 166 which are configured and dimensioned to be received within grooves 190 formed in the shelf 74. The base 162 may then be affixed to the shelf 74 by means of screws or the like. In some embodiments, the side panels 160 may be configured to hold multiple axles.

The components of the ribbon dispenser 154, such as the base 162, may be made from any suitable material using any suitable process, such as an extruded aluminum. The ribbon dispenser 154 may also be made in various widths to accommodate different widths of ribbon bobbins 183. To dispense ribbon, the leading end of the ribbon is pulled from the ribbon bobbin 183 towards the user to pass through the ribbon trimmer 158 and through the scissors 172. The action of the cut is effected by depressing a trimmer handle tab 175, whose position forward of the scissors 172 enables the user to grasp the ribbon just to the front of the scissors 172 and to depress the trimmer handle tab 175 in the same motion, thereby enabling a one-handed dispensing and cutting of the ribbon. The trimmer handle 174 is pivoted with a pivot pin 176 located at the opposite end of the trimmer handle tab 175. As the trimmer handle 174 moves downwards, the handle legs 177 push the sides of the scissors 172 inwards to affect a cut. Springs return the scissors 172 and the trimmer handle 174 to their rest position.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A rolled media cutter, comprising:

(i) at least two elongated trays formed as thin wall sections having opposing first and second ends, each of said trays comprising:

(a) a holding section comprising a concave first channel formed in said tray, wherein said concave first channel is configured to receive a roll of media therein and retain the rolled media for unrolling; and (b) a cutting section comprising a second channel disposed substantially parallel to said concave first channel, wherein the second channel is:

(1) bounded at a top side by two parallel flanges separated by a space, the flanges each having an upper surface and a lower surface;

(2) bounded at a bottom side by a bottom surface including two vertical ribs extending perpendicular to the bottom surface; and (3) bounded by two lateral sides substantially perpendicular to both the top side and the bottom side, wherein one of said lateral sides extends from the top side, past the bottom side, and intersects with at least one rib, the rib connecting said lateral side to the thin walled tray section at a point spaced apart from said flanges, and wherein the holding section and at least part of the cutting section are a monolithic part formed by extrusion or injection molding, wherein the thin wall section comprises, in order from a front to a rear of the tray:

(1) a convex curvature interrupted by said cutting section including said second channel, wherein said second channel opens generally upwards;

(2) a transition from a convex to a concave curvature;

(3) the concave first channel, wherein said first channel faces generally upwards;

(4) a transition curvature; and (5) a vertically extending portion; and (ii) a cutting mechanism slidingly coupled to said second channel wherein said cutting mechanism comprises:

(a) a blade having a cutting edge, a first end, and a second end remote from the first end, wherein a portion of said blade is configured to fit in said space;

(b) a slider coupled to said first end of said blade and configured to be retained within said second channel along at least a portion of said second channel by making contact with the lower surfaces of the two flanges and a bottom of said second channel so as to maintain a fixed relative position between the slider and the ski; and (c) a ski with a leading edge coupled to said second end of said blade disposed above said slider and blade, wherein said ski is configured to slide above said second channel and force unrolled media into contact with a top surface of the second channel prior to the unrolled media reaching the blade, wherein the fixed relative position between the slider and the ski maintains a fixed gap between the ski and the upper surfaces of the flanges, that is so dimensioned as to be substantially the thickness of the unrolled media which the unrolled media cutter is configured to cut, and wherein an acute angle is formed between the cutting edge of the blade and an underside of the ski proximate to the leading edge; and (iii) two end-caps, each one coupled to at least two elongated trays at one of the first and second ends and configured to prevent said cutting mechanism from being separated from said second channel wherein each of said end-caps further comprises:

(a) a vertical support configured to couple a first elongated tray to at least an additional elongated tray in a modular relation.

2. The rolled media cutter of claim 1, further comprising:

a shelf;

at least one support having a first end configured to be coupled to at least one of said trays and an opposing second end configured to be coupled to said shelf, where once assembled, at least one tray and said shelf are stacked one above the other substantially parallel to one another.

3. The rolled media cutter of claim 2, wherein said shelf comprises at least one accessory.

4. The rolled media cutter of claim 3, wherein said at least one accessory comprises a tape dispenser.

5. The rolled media cutter of claim 4, wherein said at least one accessory further comprises a ribbon dispenser.

6. The rolled media cutter of claim 5, wherein the ribbon dispenser comprises a ribbon trimmer.

7. The rolled media cutter of claim 1, wherein the slider further comprises at least one protruding shoulder configured to slide within the channel and to prevent the cutting mechanism from being separated from said second channel.

8. The rolled media cutter of claim 1, wherein said ski further comprises a leading edge that is sloped upwards.

9. The rolled media cutter of claim 1, wherein the surface of said first channel has a curvature configured to receive rolled media therein.

10. The rolled media cutter of claim 1, further comprising at least one axle supported by said vertical supports wherein said axle is configured to hold the media in said first channel.

11. The rolled media cutter of claim 1, wherein said cutting mechanism is removable from said second channel along at least a portion of said second channel.

12. The rolled media cutter of claim 1, wherein at least part of the holding section and at least part of the cutting section are integrally formed by injection molding.

13. The rolled media cutter of claim 1, wherein the gap is one millimeter or less.

14. The rolled media cutter of claim 1, wherein the second channel has a first end and a second end, and the cutting mechanism has a first blade and a second blade, where the first blade is configured to contact the unrolled media when the cutting mechanism is moved toward the first end of the second channel, and the second blade is configured to contact the unrolled media when the cutting mechanism is moved toward the second end of the second channel.

15. The rolled media cutter of claim 1, wherein the elongated tray is made of plastic.

16. The rolled media cutter of claim 1, wherein the ski is separate and distinct from the slider.

* * * * *